US011253754B2

(12) United States Patent
Kogawa et al.

(10) Patent No.: US 11,253,754 B2
(45) Date of Patent: Feb. 22, 2022

(54) GOLF CLUB AND CONNECTING MEMBER FOR GOLF CLUB SHAFT AND GOLF CLUB HEAD

(71) Applicant: FUJIKURA COMPOSITES INC., Tokyo (JP)

(72) Inventors: Yoshihito Kogawa, Saitama (JP); Keigo Takahashi, Saitama (JP)

(73) Assignee: Fujikura Composites, Inc., Tokyo (JP)

( * ) Notice: Subject to any disclaimer, the term of this patent is extended or adjusted under 35 U.S.C. 154(b) by 0 days.

(21) Appl. No.: 16/622,315

(22) PCT Filed: Jun. 14, 2017

(86) PCT No.: PCT/JP2017/021945

§ 371 (c)(1),
(2) Date: Dec. 13, 2019

(87) PCT Pub. No.: WO2018/229893

PCT Pub. Date: Dec. 20, 2018

(65) Prior Publication Data

US 2020/0360770 A1 Nov. 19, 2020

(51) Int. Cl.

| | |
|---|---|
| ***A63B 53/10*** | (2015.01) |
| ***A63B 53/12*** | (2015.01) |
| ***A63B 53/02*** | (2015.01) |
| ***A63B 53/04*** | (2015.01) |

(52) U.S. Cl.

CPC ..... *A63B 53/02* (2013.01); *A63B 53/0487* (2013.01); *A63B 2209/02* (2013.01)

(58) Field of Classification Search

CPC ..... A63B 53/02
USPC ..... 473/305–315
See application file for complete search history.

(56) References Cited

U.S. PATENT DOCUMENTS

| | | | | | |
|---|---|---|---|---|---|
| 826,102 | A | * | 7/1906 | Hersey | A63B 60/00 473/308 |
| 1,487,707 | A | * | 3/1924 | Benton | A63B 53/02 473/308 |
| 1,652,594 | A | * | 12/1927 | Walker | A63B 53/02 473/308 |
| 3,848,737 | A | * | 11/1974 | Kenon | A63B 53/02 206/315.2 |
| 3,873,090 | A | * | 3/1975 | Thompson | A63B 53/02 473/312 |

(Continued)

FOREIGN PATENT DOCUMENTS

| | | | |
|---|---|---|---|
| CN | 1082984 | A | 3/1994 |
| CN | 1118705 | A | 3/1996 |

(Continued)

OTHER PUBLICATIONS

International Search Report for Application No. PCT/JP2017/021945 dated Jul. 27, 2017.

(Continued)

*Primary Examiner* — Alvin A Hunter
(74) *Attorney, Agent, or Firm* — McCormick, Paulding & Huber PLLC

(57) ABSTRACT

To obtain a golf club and a connecting member for a golf club shaft and a golf club head that can provide a flexibility in choice of reshafting to a user regardless of types of the golf club shaft and the golf club head and that can also provide excellent strength and/or appearance. A connecting member connects an inner-hosel-type golf club shaft and an over-hosel-type golf club head. The connecting member includes a hybrid structure combining different kinds of material.

4 Claims, 12 Drawing Sheets

(56) References Cited

U.S. PATENT DOCUMENTS

| | | | | | |
|---|---|---|---|---|---|
| 5,277,423 | A * | 1/1994 | Artus | A63B 60/00 | 473/319 |
| 5,439,218 | A * | 8/1995 | Gondeck | A63B 60/00 | 473/308 |
| 5,643,105 | A * | 7/1997 | Niswander | A63B 60/00 | 473/308 |
| 6,287,215 | B1 * | 9/2001 | Fisher | A63B 53/007 | 473/309 |
| 6,575,843 | B2 * | 6/2003 | McCabe | A63B 53/0466 | 473/245 |
| 6,582,320 | B2 * | 6/2003 | Fendel | A63B 53/14 | 473/312 |
| 6,767,422 | B1 | 7/2004 | Atsumi et al. | | |
| 6,966,847 | B2 * | 11/2005 | Lenhof | A63B 53/02 | 473/305 |
| 7,207,897 | B2 * | 4/2007 | Burch | A63B 53/02 | 473/288 |
| 7,351,159 | B2 * | 4/2008 | Lai | A63B 60/54 | 473/305 |
| 7,931,542 | B2 * | 4/2011 | Kusumoto | A63B 53/02 | 473/288 |
| 2004/0192468 | A1 | 9/2004 | Onoda et al. | | |
| 2008/0280696 | A1 | 11/2008 | Lau | | |
| 2016/0367873 | A1 | 12/2016 | Kogawa et al. | | |

FOREIGN PATENT DOCUMENTS

| | | | |
|---|---|---|---|
| CN | 1522775 | A | 8/2004 |
| CN | 1539534 | A | 10/2004 |
| CN | 1602982 | A | 4/2005 |
| CN | 105792902 | A | 7/2016 |
| DE | 40 06 658 | A1 | 8/1991 |
| JP | S51-049172 | U | 10/1949 |
| JP | S59-150470 | U | 10/1984 |
| JP | S62-194376 | U | 12/1987 |
| JP | 3023351 | U | 4/1996 |
| JP | 2000-325511 | A | 11/2000 |
| JP | 2001-198244 | A | 7/2001 |
| JP | 2002-253715 | A | 9/2002 |
| JP | 3120767 | U | 4/2006 |
| JP | 2006-297926 | A | 11/2006 |
| JP | 2008114027 | A * | 5/2008 |
| JP | 2008307100 | A * | 12/2008 |
| JP | 2009066122 | A * | 4/2009 |

OTHER PUBLICATIONS

Steal to Kikaku! Putter-yo Carbon Shaft Diamana P1325 Sochaku, HOLY Blog (Kabushiki Kaisha HOLY Homepage) [online], Apr. 21, 2017 (Apr. 21, 2017), entire text, all drawings (particularly, 3rd to 5th photographs, [retrieval date Aug. 22, 2017 (Aug. 22, 2017)], Internet: <URL:http://www.e-holy.jp/blog/diamana_P135_vs_steel/>.

Chinese Office Action for Chinese Patent Application No. 201780091966.2 dated Aug. 31, 2020 and its English Translation.

International Search Report for Application No. PCT/JP2017/007621 dated Apr. 14, 2017.

* cited by examiner

GOLF CLUB AND CONNECTING MEMBER FOR GOLF CLUB SHAFT AND GOLF CLUB HEAD

CROSS REFERENCE TO RELATED APPLICATION

This application is a National Stage application of International Patent Application No. PCT/JP2017/021945 filed on Jun. 14, 2017, which is hereby incorporated by reference in its entirety.

TECHNICAL FIELD OF THE INVENTION

The present invention relates to a golf club and a connecting member for a golf club shaft and a golf club head.

BACKGROUND OF THE INVENTION

As illustrated in JP2000-325511A, an inner-hosel-type and an over-hosel-type have been known as a connecting structure of a golf club shaft and a golf club head. The inner-hosel-type is a type where a shaft mounting hole is formed on a hosel of the golf club head and a distal end portion of the golf club shaft is inserted into this shaft mounting hole. The over-hosel-type is a type where a shaft mounting shaft is formed on a hosel of the golf club head and a hollow portion of the golf club shaft is inserted into this shaft mounting shaft.

JP2001-198244A discloses that, in an over-hosel-type golf club, a prepreg in a circumferential direction containing a metal thin wire is wound around an outer periphery of a mouth portion, as a portion mounted on a golf club head, of a golf club shaft to form a reinforcing layer.

SUMMARY OF THE INVENTION

Incidentally, the golf club shaft includes a type 1 applicable to both of an inner-hosel-type golf club head and an over-hosel-type golf club head and a type 2 applicable to the inner-hosel-type golf club head but inapplicable to the over-hosel-type golf club head.

In view of this, even if a user who uses a golf club where the golf club shaft of the type 1 is connected to the over-hosel-type golf club head desired to reshaft to the golf club shaft of the type 2 without changing the over-hosel-type golf club head, it has been conventional common technical knowledge that the desire would not be responded.

Actually, at the time of selling the golf club shaft (at the time of reshafting), it is required to confirm in advance whether the golf club shaft after reshafting is insertable into the golf club head before reshafting or not. Provisionally, if it is not insertable, the user had to give up.

Based on the above-described awareness on the problem, the applicant has filed an international patent application for technologies that can provide a flexibility in choice of reshafting to a user regardless of types of the golf club shaft and the golf club head (PCT/JP2017/007621).

As a result of further diligent research after filing the above-mentioned international patent application, the present inventors have made improvements by focusing on the strength and/or appearance of the golf club, and as a result, have conceived the present invention.

The present invention has been made based on the above-described awareness on the problem, and it is an object of the present invention to obtain a golf club and a connecting member for a golf club shaft and a golf club head that can provide a flexibility in choice of reshafting to a user regardless of types of the golf club shaft and the golf club head, and that can provide a golf club and a connecting member for a golf club shaft and a golf club head with excellent strength and/or appearance.

A golf club according to an aspect of the present invention includes an inner-hosel-type golf club shaft, an over-hosel-type golf club head, and a connecting member that connects the inner-hosel-type golf club shaft to the over-hosel-type golf club head, and includes a hybrid structure combining different kinds of material.

It is possible that the connecting member includes an FRP material as at least one of different kinds of material.

It is possible that the inner-hosel-type golf club shaft has an inserted cylindrical portion, the over-hosel-type golf club head has an inserted shaft portion, and the connecting member is formed of a tubular member into which the inserted cylindrical portion and the inserted shaft portion are inserted from opposite directions, and the tubular member is bonded on outer peripheral surfaces of the inserted cylindrical portion and the inserted shaft portion.

It is possible that the tubular member includes an inner layer tubular portion along the outer peripheral surfaces of the inserted cylindrical portion and the inserted shaft portion, and an outer layer tubular portion along the outer peripheral surface of the inner layer tubular portion.

It is possible that the inner layer tubular portion is formed of a metal material, and the outer layer tubular portion is formed of an FRP material.

It is possible that the inner layer tubular portion is formed of an FRP material, and the outer layer tubular portion is formed of a metal material.

It is possible that the inner layer tubular portion includes a part along the outer peripheral surface of the inserted cylindrical portion formed of an FRP material and a part along the outer peripheral surface of the inserted shaft portion formed of a metal material, and that the outer layer tubular portion is formed of an FRP material.

It is possible that the inner layer tubular portion includes a part along the outer peripheral surface of the inserted cylindrical portion formed of an FRP material and a part along the outer peripheral surface of the inserted shaft portion formed of a metal material, and that the outer layer tubular portion is formed of a metal material.

A connecting member for a golf club shaft and a golf club head according to an aspect of the present invention connects an inner-hosel-type golf club shaft and an over-hosel-type golf club head and includes a hybrid structure combining different kinds of material.

The present invention can obtain the golf club and the connecting member for the golf club shaft and the golf club head that can provide the flexibility in choice of reshafting to the user regardless of the types of the golf club shaft and the golf club head, and that can also provide excellent strength and/or appearance.

DETAILED DESCRIPTION

Figure 1:
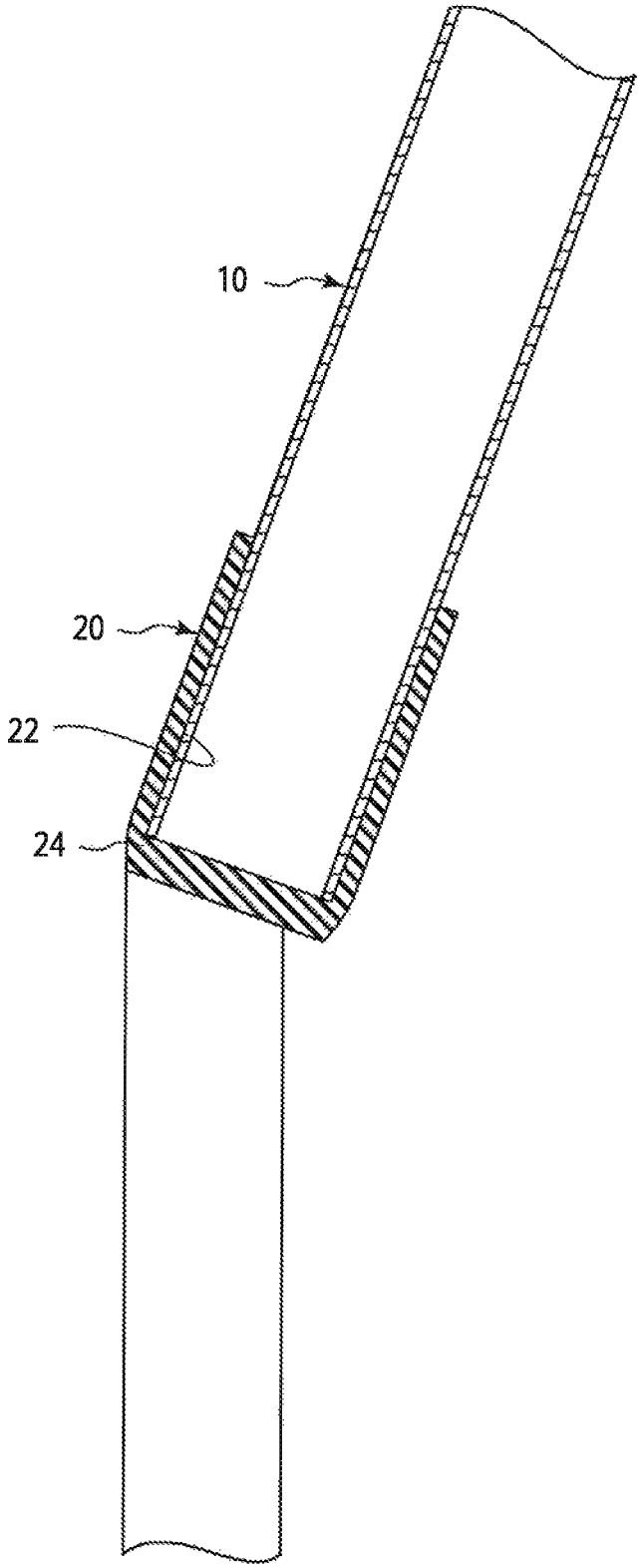
FIG. 1 is a cross-sectional view illustrating a connected portion of a steel golf club shaft and an inner-hosel-type golf club head.

FIG. 1 is a cross-sectional view illustrating a connected portion of a steel golf club shaft 10 and an inner-hosel-type golf club head (putter club head) 20.

The steel golf club shaft 10 is configured from a hollow tubular member having relatively a thin wall and a large inner diameter (compared with a carbon golf club shaft 30, which is described later).

The inner-hosel-type golf club head 20 is entirely formed of a metal material and has a hosel 24 on which a shaft insertion hole 22 is formed. The shaft insertion hole 22 has an inner diameter that is set identical to or slightly larger than an outer diameter of the steel golf club shaft 10. The steel golf club shaft 10 is connected to the inner-hosel-type golf club head 20 by inserting a distal end portion (an outer diameter portion) of the steel golf club shaft 10 into the shaft insertion hole 22 of the inner-hosel-type golf club head 20 to be bonded.

Figure 2:
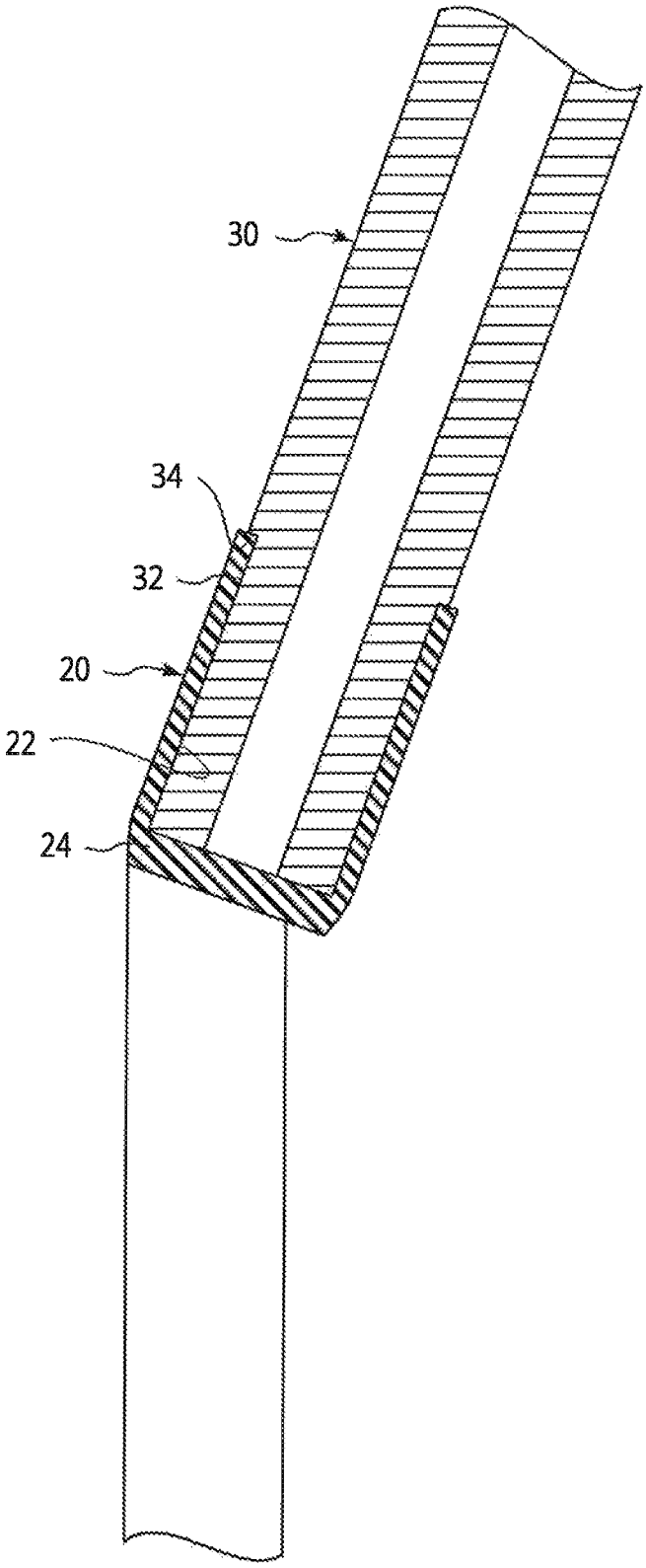
FIG. 2 is a cross-sectional view illustrating a connected portion of a carbon golf club shaft and the inner-hosel-type golf club head.
Figure 3:
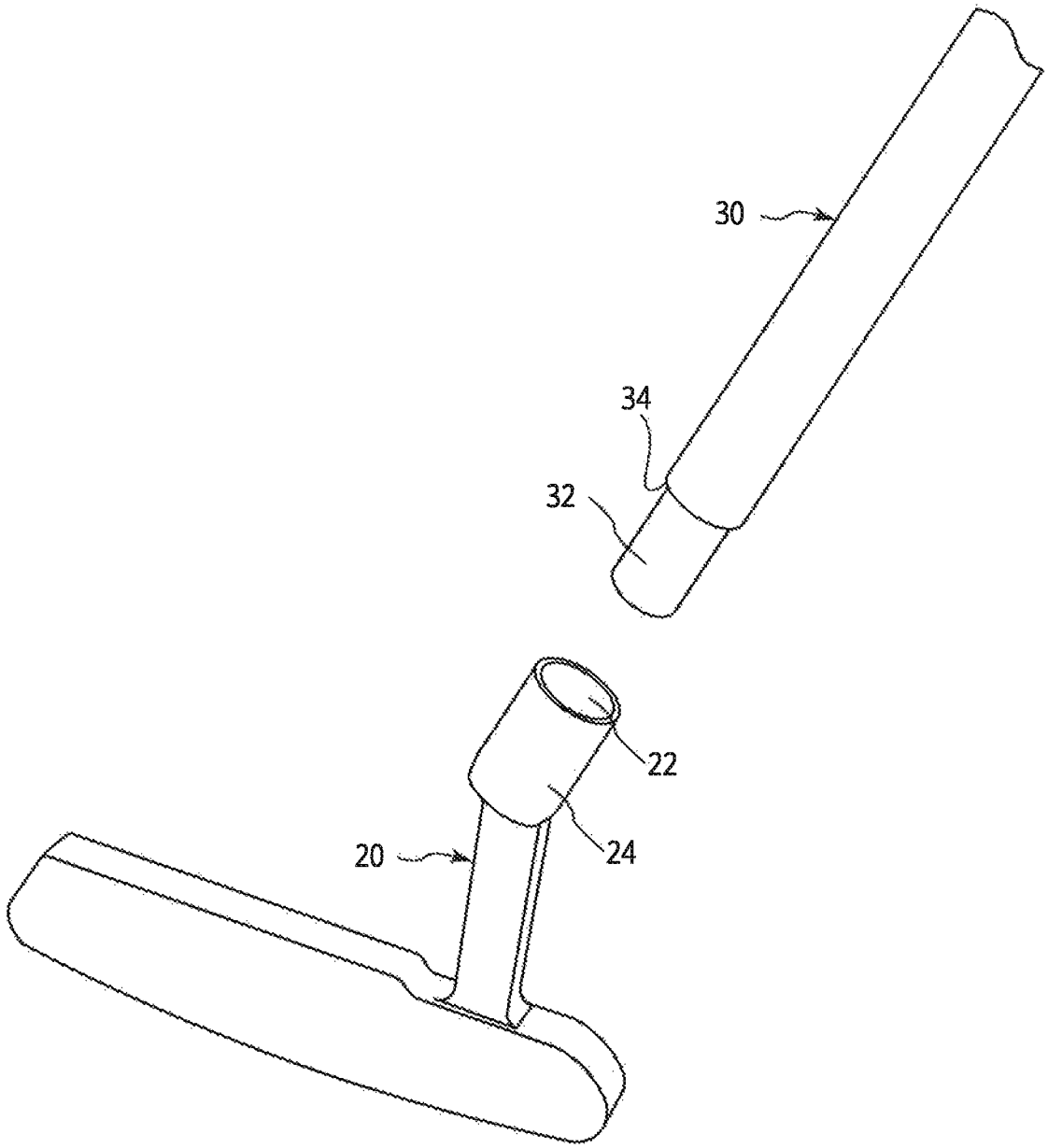
FIG. 3 is a perspective view illustrating a separation state of the carbon golf club shaft and the inner-hosel-type golf club head.
Figure 4:
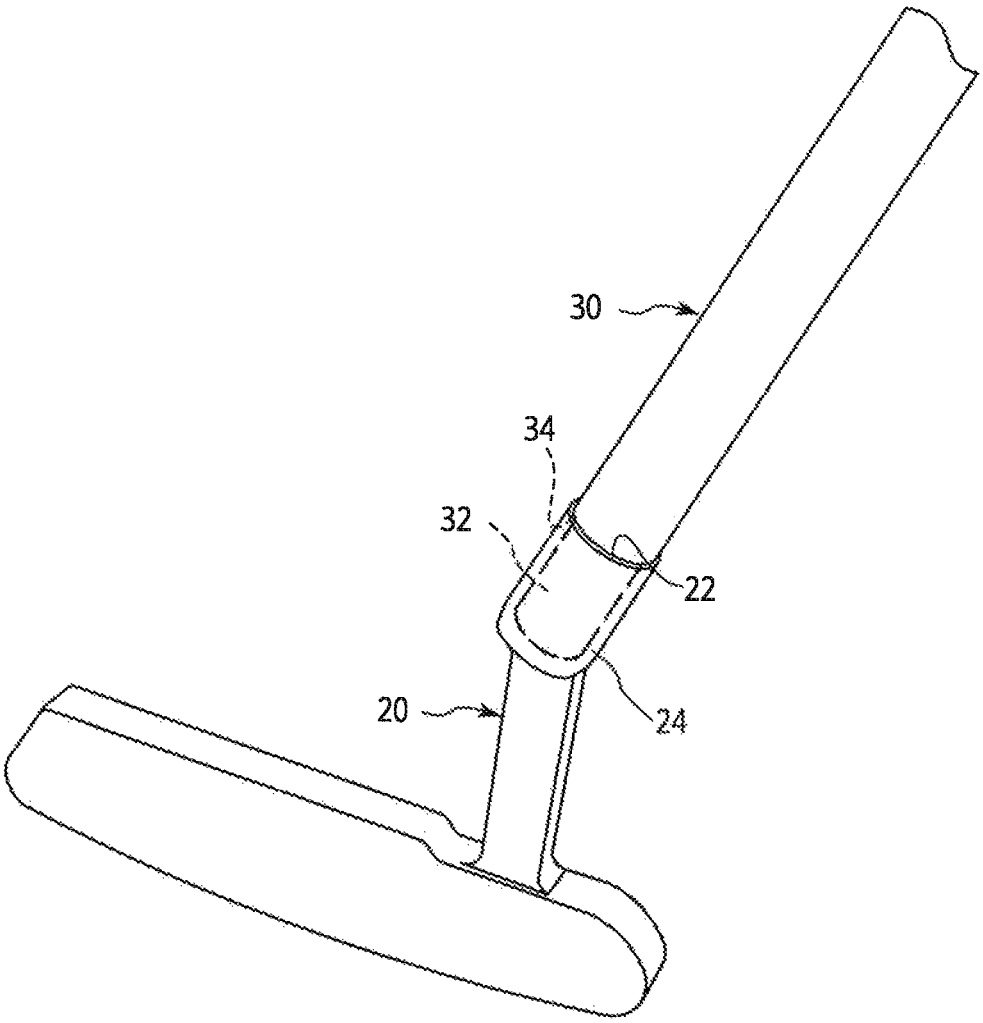
FIG. 4 is a perspective view illustrating a connected state of the carbon golf club shaft and the inner-hosel-type golf club head.

FIG. 2 is a cross-sectional view illustrating a connected portion of the carbon (Carbon Fiber Reinforced Plastics (CFRP)) golf club shaft 30 and the inner-hosel-type golf club head (putter club head) 20. FIG. 3 and FIG. 4 are perspective views illustrating a separation state and a connected state of the carbon golf club shaft 30 and the inner-hosel-type golf club head (putter club head) 20.

The carbon golf club shaft 30 is formed of a thermally cured prepreg where a thermosetting resin is immersed in a carbon fiber. The carbon golf club shaft 30 is configured from a hollow tubular member having relatively a thick wall and a small inner diameter (compared with the above-described steel golf club shaft 10). An inserted cylindrical portion (an opposite cylindrical portion) 32 and an abutting stepped portion 34, which defines this inserted cylindrical portion 32, are formed on a distal end side of the carbon golf club shaft 30. The inserted cylindrical portion 32 extends in an axial direction. The abutting stepped portion 34 extends in a direction perpendicular to the axis. The carbon golf club shaft 30 is connected to the inner-hosel-type golf club head 20 by inserting the inserted cylindrical portion 32 of the carbon golf club shaft 30 into the shaft insertion hole 22 of the inner-hosel-type golf club head 20 to be bonded.

Figure 5:
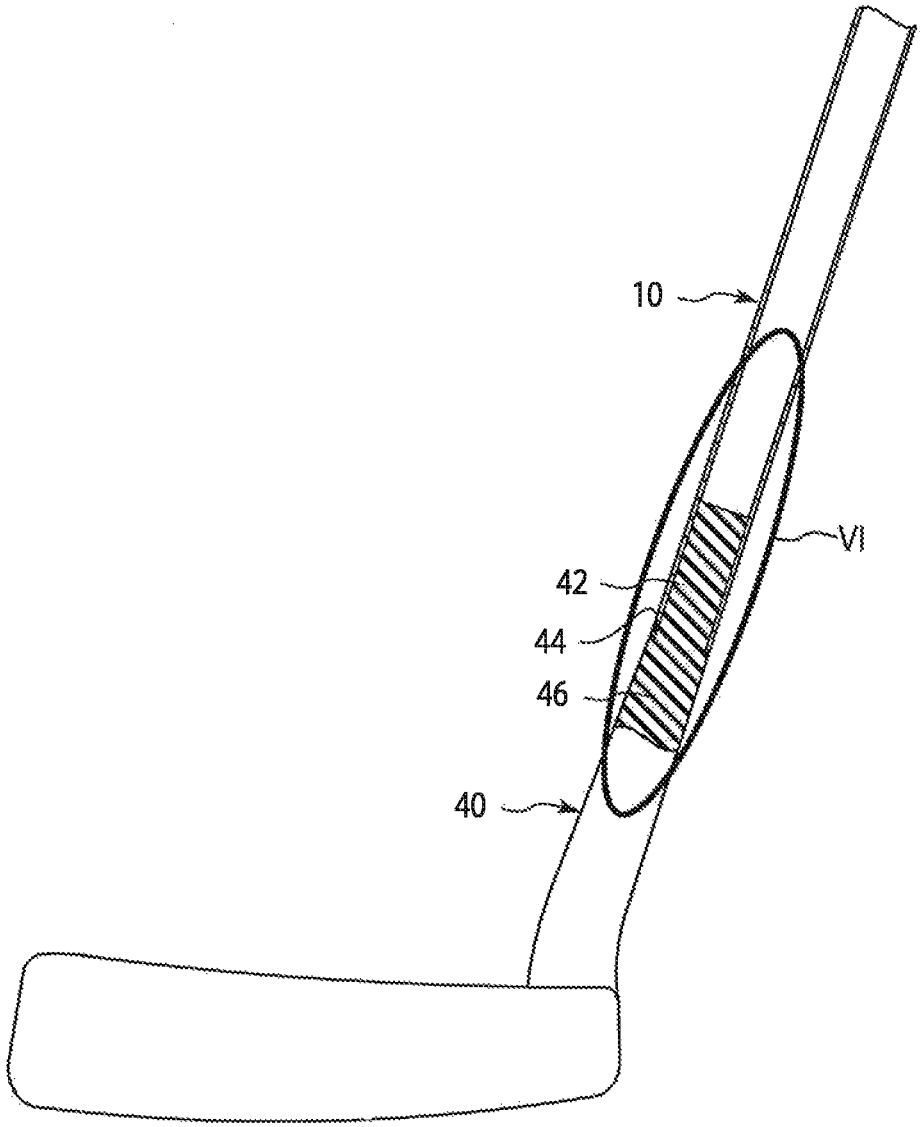
FIG. 5 is a cross-sectional view illustrating a connected portion of the steel golf club shaft and an over-hosel-type golf club head.
Figure 6:
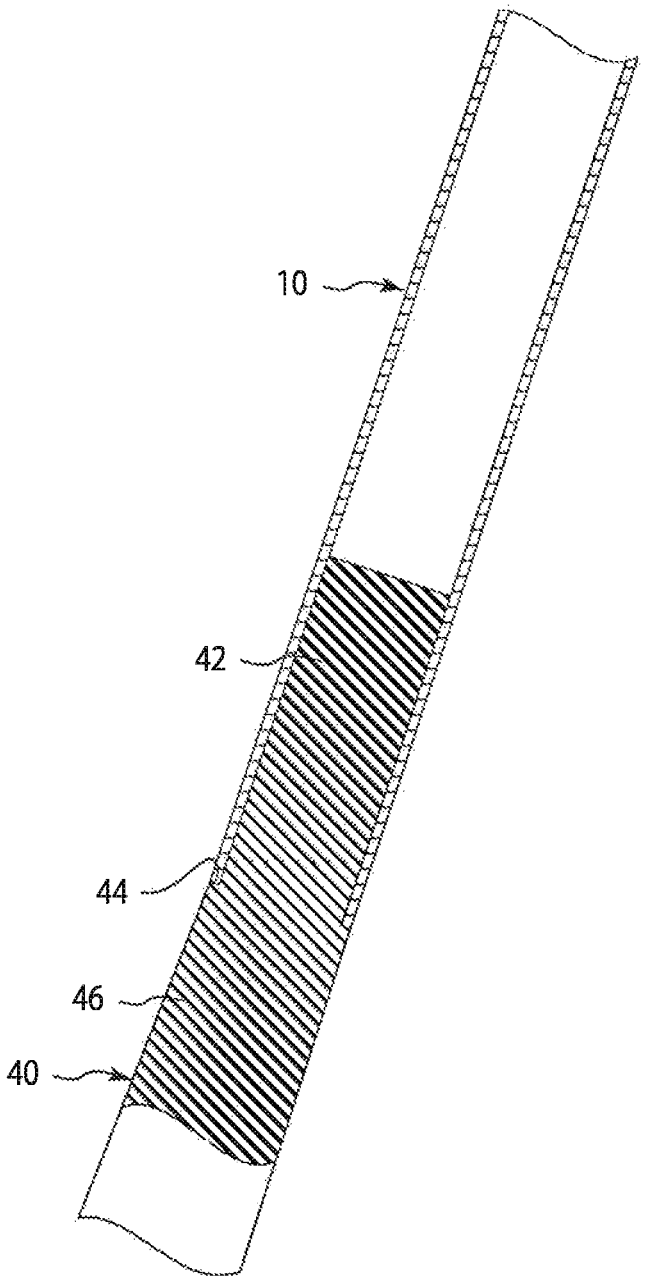
FIG. 6 is an enlarged view of a part VI in FIG. 5.

FIG. 5 is a cross-sectional view illustrating a connected portion of the steel golf club shaft 10 and an over-hosel-type golf club head (putter club head) 40. FIG. 6 is an enlarged view of a part VI in FIG. 5.

The over-hosel-type golf club head 40 is entirely formed of a metal material and has a hosel 46 on which an inserted shaft portion (an opposite shaft portion) 42 and an abutting stepped portion 44, which defines the inserted shaft portion 42, are formed. The inserted shaft portion 42 extends in an axial direction. The abutting stepped portion 44 extends in a direction perpendicular to the axis. The inserted shaft portion 42 has an outer diameter set identical to or slightly smaller than an inner diameter of the steel golf club shaft 10. The steel golf club shaft 10 is connected to the over-hosel-type golf club head 40 by inserting a distal end portion (an inner diameter portion) of the steel golf club shaft 10 into the inserted shaft portion 42 of the over-hosel-type golf club head 40 to be bonded.

Thus, the steel golf club shaft 10 is connectable to (mountable on, insertable into) both of the inner-hosel-type golf club head 20 and the over-hosel-type golf club head 40. In this mean, the steel golf club shaft 10 doubles as an "inner-hosel-type golf club shaft" and an "over-hosel-type golf club shaft" (a golf club shaft of a type double as the inner hosel/the over hosel).

In contrast, the carbon golf club shaft 30 is connectable to (mountable on, insertable into) the inner-hosel-type golf club head 20 but is not connectable to (not mountable on, not insertable into) the over-hosel-type golf club head 40. In this mean, the carbon golf club shaft 30 is an "inner-hosel-type golf club shaft (inner-hosel-dedicated-type golf club shaft)."

A reason why the carbon golf club shaft 30 is not connectable to the over-hosel-type golf club head 40 is that the carbon golf club shaft 30 has to have a thick wall and a small inner diameter to guarantee strength, and therefore the carbon golf club shaft 30 is not insertable into the inserted shaft portion 42 of the over-hosel-type golf club head 40.

In view of this, even if a user who uses a golf club (FIG. 5, FIG. 6) where the steel golf club shaft 10 is connected to the over-hosel-type golf club head 40 desired to reshaft to the carbon golf club shaft 30 without changing the over-hosel-type golf club head 40, it has been conventional common technical knowledge that the desire would not be responded.

Actually, at the time of selling the golf club shaft (at the time of reshafting), it is required to confirm in advance whether the golf club shaft after reshafting is insertable into the golf club head before reshafting or not. Provisionally, if it is not insertable, the user had to give up.

The inventors, considering this point as one technical problem, have succeeded in connection of the carbon golf club shaft (the inner-hosel-type golf club shaft) 30 and the over-hosel-type golf club head (putter club head) 40 using a tubular member (a connecting member) 50 as an outside attachment to provide flexibility in choice of reshafting to the user regardless of types of the golf club shaft and the golf club head.

Figure 7:
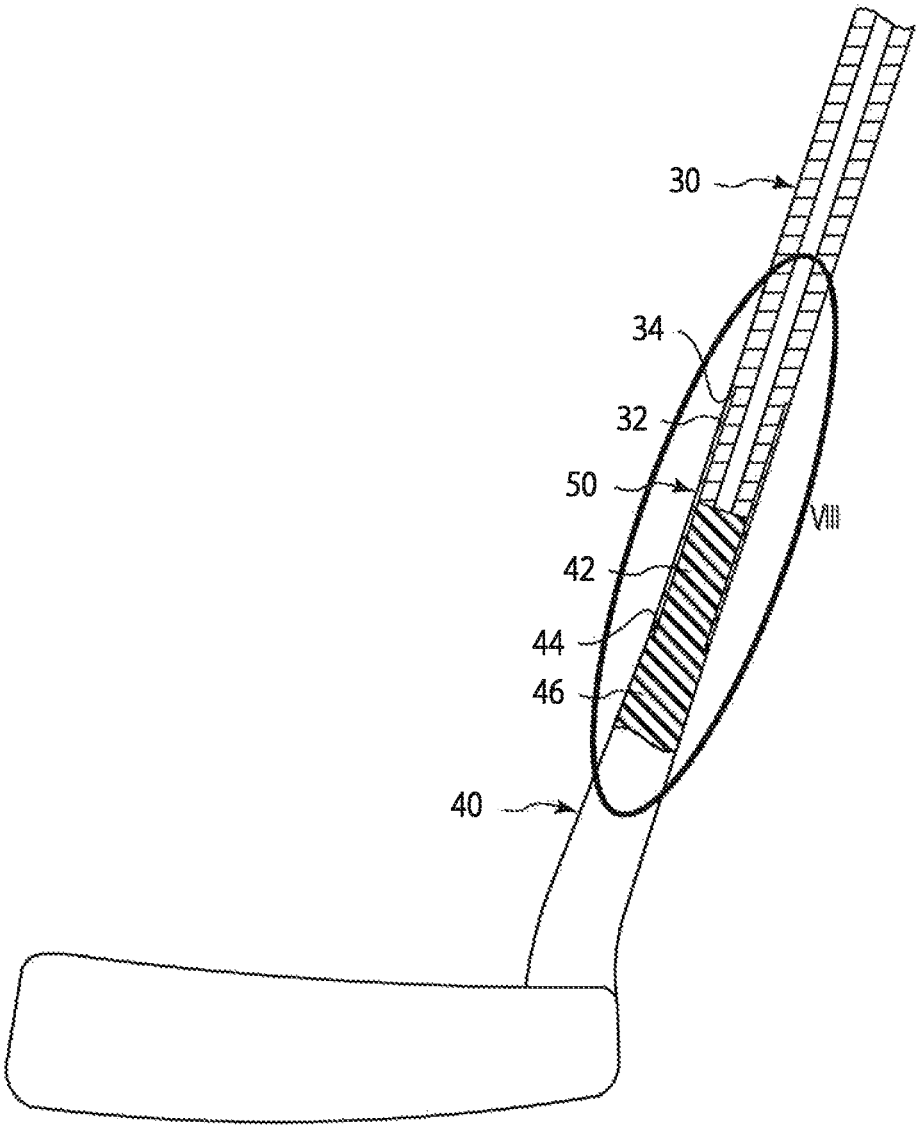
FIG. 7 is a cross-sectional view illustrating a connected portion of the carbon golf club shaft, the over-hosel-type golf club head, and a tubular member.
Figure 8:
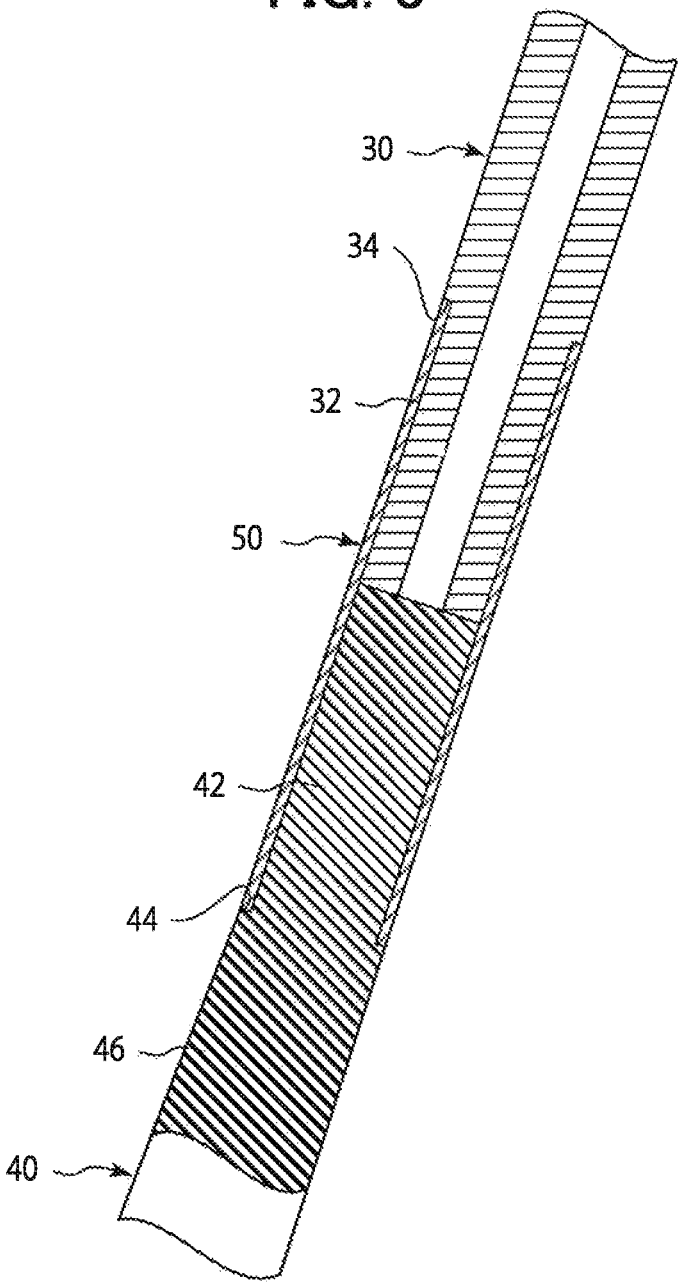
FIG. 8 is an enlarged view of a part VIII in FIG. 7.
Figure 9:
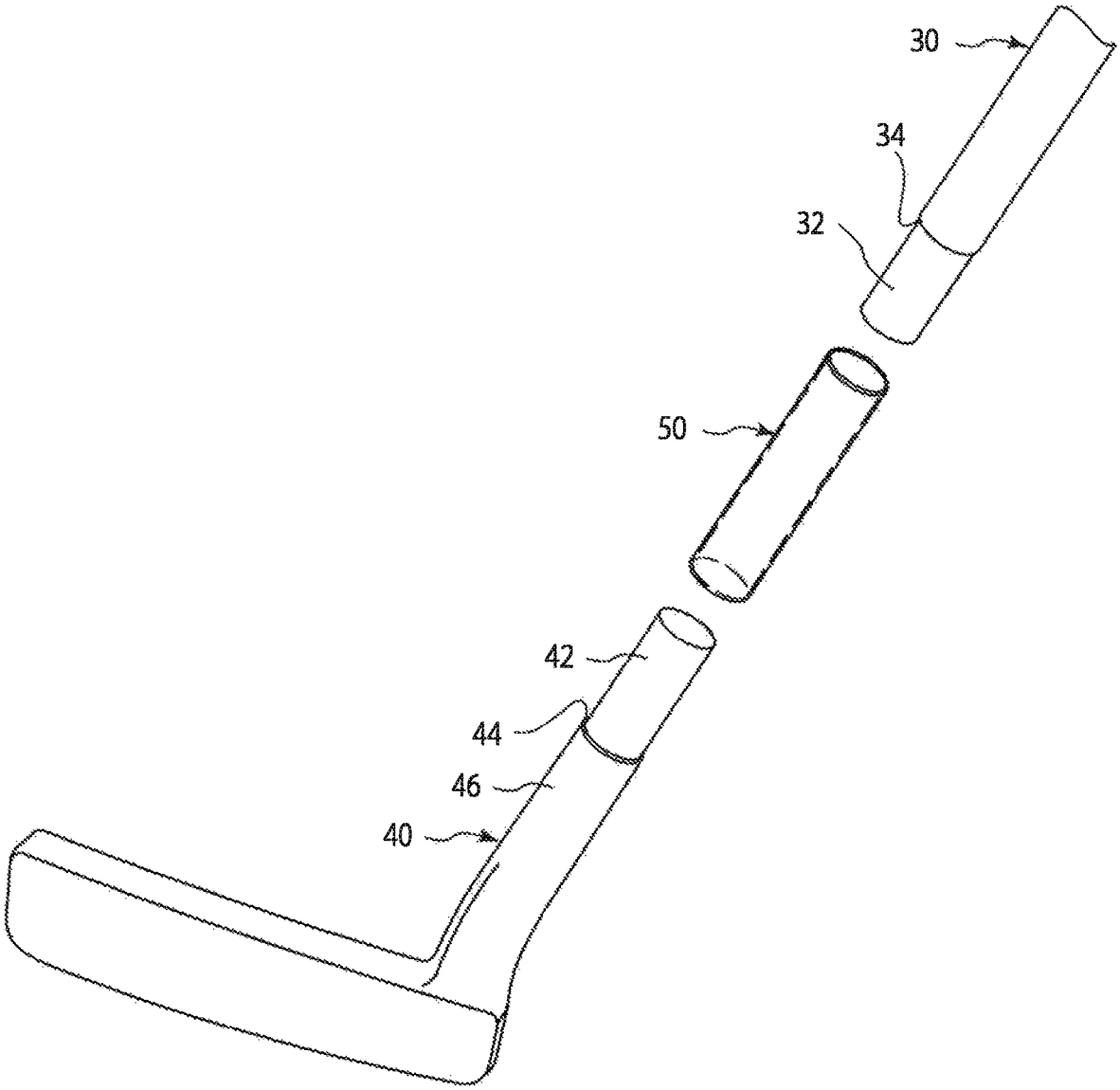
FIG. 9 is a perspective view illustrating a separation state of the carbon golf club shaft, the over-hosel-type golf club head, and the tubular member.
Figure 10:
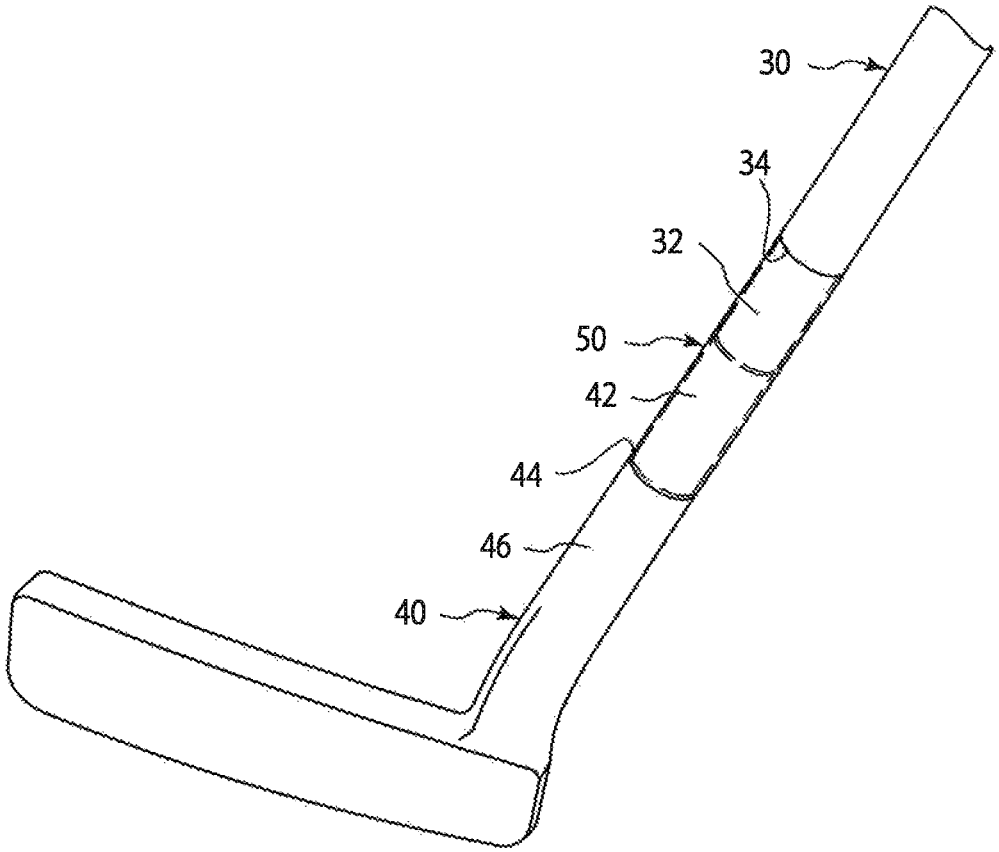
FIG. 10 is a perspective view illustrating a connected state of the carbon golf club shaft, the over-hosel-type golf club head, and the tubular member.

FIG. 7 is a cross-sectional view illustrating a connected portion of the carbon golf club shaft 30, the over-hosel-type golf club head (putter club head) 40, and the tubular member 50. FIG. 8 is an enlarged view of a part VIII in FIG. 7. FIG. 9 and FIG. 10 are perspective views illustrating a separation state and a connected state of the carbon golf club shaft 30, the over-hosel-type golf club head (putter club head) 40, and the tubular member 50. In FIG. 10, an inside can be visually perceived by illustrating the tubular member 50 in skeleton.

The inserted cylindrical portion 32 of the carbon golf club shaft 30 and the inserted shaft portion 42 of the over-hosel-type golf club head 40 are inserted into the tubular member 50 from opposite directions. The inserted cylindrical portion 32 and the inserted shaft portion 42 have approximately identical diameters, and a distal end surface of the inserted cylindrical portion 32 is butted to a distal end surface of the inserted shaft portion 42 inside the tubular member 50 (FIG. 8). One end portion (one end surface) of the tubular member 50 is abutted on the abutting stepped portion 34 of the carbon golf club shaft 30, and another end portion (another end surface) of the tubular member 50 is abutted on the abutting stepped portion 44 of the over-hosel-type golf club head 40 (FIG. 8). Thus, the carbon golf club shaft 30, the over-hosel-type golf club head 40, and the tubular member 50 are assembled in a state where movement in the axial direction and the direction perpendicular to the axis is restricted (in a state where coaxiality is guaranteed).

A height of the abutting stepped portion 34, a height of the abutting stepped portion 44, and a thickness of the tubular member 50 are approximately identically set. As a result, an outer peripheral surface of the tubular member 50, an outer peripheral surface of a part on which the inserted cylindrical portion 32 is not formed (a part on a base end side with respect to the abutting stepped portion 34) in the carbon golf club shaft 30, and an outer peripheral surface of a part on which the inserted shaft portion 42 is not formed (a part on a base end side with respect to the abutting stepped portion 44) in the hosel 46 of the over-hosel-type golf club head 40 are approximately disposed on an identical plane (FIG. 8).

An adhesive is filled between the outer peripheral surfaces of the inserted cylindrical portion 32 and the inserted shaft portion 42 and an inner peripheral surface of the tubular member 50 to be bonded. The adhesive is filled between the distal end surface of the inserted cylindrical portion 32 and the distal end surface of the inserted shaft portion 42 to be bonded. Furthermore, the adhesive is filled between the abutting stepped portion 34 and the one end portion (the one end surface) of the tubular member 50 and between the abutting stepped portion 44 and the other end portion (the other end surface) of the tubular member 50 to be bonded. Thus, the carbon golf club shaft 30, the over-hosel-type golf club head 40, and the tubular member 50 are connected.

When the carbon golf club shaft 30, the over-hosel-type golf club head 40, and the tubular member 50 are connected, the adhesive is applied over the outer peripheral surface and the distal end surface of the inserted cylindrical portion 32 and the abutting stepped portion 34 in the golf club shaft 30, the outer peripheral surface and the distal end surface of the inserted shaft portion 42 and the abutting stepped portion 44 in the golf club head 40, and the inner peripheral surface of the tubular member 50. Then, the inserted cylindrical portion 32 of the carbon golf club shaft 30 and the inserted shaft portion 42 of the over-hosel-type golf club head 40 are inserted into the tubular member 50 from the opposite directions. Then, the distal end surface of the inserted cylindrical portion 32 is butted to the distal end surface of the inserted shaft portion 42 inside the tubular member 50, the one end portion (the one end surface) of the tubular member 50 is abutted on the abutting stepped portion 34, and the other end portion (the other end surface) of the tubular member 50 is abutted on the abutting stepped portion 44. The adhesive is cured in this state to connect the carbon golf club shaft 30, the over-hosel-type golf club head 40, and the tubular member 50.

Thus, the embodiment ensures the connection of the carbon golf club shaft (the inner-hosel-type golf club shaft) 30 and the over-hosel-type golf club head (putter club head) 40 using the tubular member (the connecting member) 50 as the outside attachment. That is, the flexibility in choice of reshafting can be provided to the user regardless of the types of the golf club shaft and the golf club head.

The tubular member (the connecting member) 50 has a hybrid structure combining different kinds of material in order to increase the strength and/or improve the appearance of the golf club. Hereinafter, exemplary cases of a first to fourth embodiments of the hybrid structure of the tubular member 50 will be described.

First Embodiment

Figure 11:
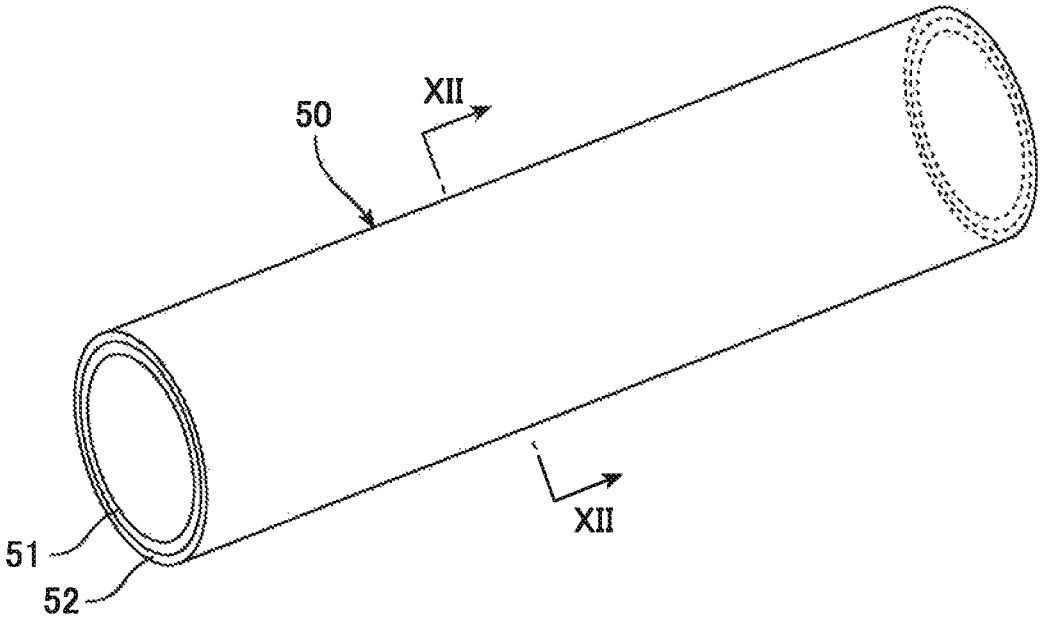
FIG. 11 is a perspective view illustrating a single structure of a tubular member according to a first embodiment.
Figure 12:
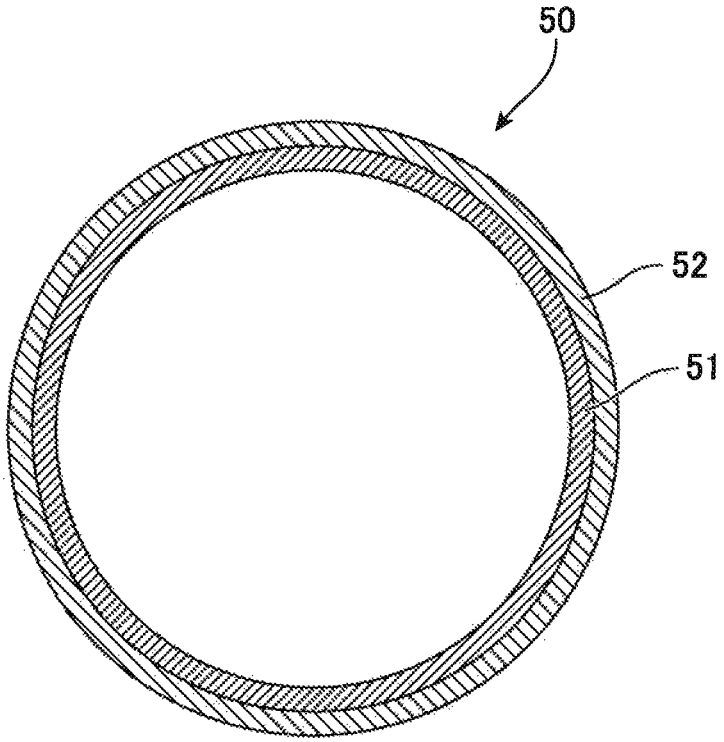
FIG. 12 is a cross-sectional view taken along the line XII-XII of FIG. 11.

FIG. 11 is a perspective view illustrating a single structure of the tubular member according to a first embodiment. FIG. 12 is a cross-sectional view taken along the line XII-XII of FIG. 11.

As shown in FIGS. 11 and 12, the tubular member 50 has an inner layer tubular portion 51 and an outer layer tubular portion 52 (has a hybrid structure using different materials for the inner and outer layers). The inner layer tubular portion 51 has a substantially uniform cross section in the longitudinal direction so as to be along the outer peripheral surface of the inserted cylindrical portion 32 of the carbon golf club shaft 30 and the outer peripheral surface of the inserted shaft portion 42 of the over-hosel-type golf club head 40. The outer layer tubular portion 52 has a substantially uniform cross section in the longitudinal direction so as to be along the outer peripheral surface of the inner layer tubular portion 51.

The inner layer tubular portion 51 is a tubular member (metal tube) configured from a metal material (for example, the same metal material as the over-hosel-type golf club head 40). The outer layer tubular portion 52 is an FRP layer configured from an FRP (Fiber Reinforced Plastics) material (for example, the same CFRP material as the carbon golf club shaft 30). The outer layer tubular portion 52 can be formed of a thermally cured prepreg where a thermosetting resin is immersed in a reinforcing fiber. As for a prepreg (an uncured thermosetting resin prepreg), in addition to a UD prepreg where fiber directions are aligned in one direction, a biaxial woven fabric prepreg, a triaxial woven fabric prepreg, a quadriaxial woven fabric prepreg, or the like can be used.

The tubular member 50 is manufactured (produced) by integrating the inner layer tubular portion (metal tube) 51 with the outer layer tubular portion (FRP layer) 52 that is formed by winding a prepreg around the outer peripheral surface of the inner layer tubular portion (metal tube) 51 and thermally curing the prepreg.

While there is a degree of freedom in how to set the radial thicknesses of the inner layer tubular portion 51 and the outer layer tubular portion 52, for example, the ratio of the radial thickness of the inner layer tubular portion 51 to the radial thickness of the tubular member 50 including the inner layer tubular portion 51 and the outer layer tubular portion 52 can be set in the range of 0.1-0.9.

By forming the inner layer tubular portion 51 of a metal tubular member (a metal tube), the accuracy of the inner diameter is increased and the adjustment of the inner diameter with respect to the inserted cylindrical portion 32 of the carbon golf club shaft 30 and the inserted shaft portion 42 of the over-hosel-type golf club head 40 can be facilitated. Since the inner surface of the inner layer tubular portion 51 and the outer surface of the inserted shaft portion 42 of the over-hosel-type golf club head 40 are bonded by metal to metal bonding (preferably the same metal material), it can be easy to select an adhesive and the adhesive strength between the two can be increased. As a result, for example, the strength of the tubular member 50 compared with the case where the tubular member 50 is an integrally molded product of an FRP material, and consequently the strength of the golf club where the carbon golf club shaft 30 is connected to the over-hosel-type golf club head 40 by the tubular member 50 can be increased.

On the other hand, with respect to the appearance, the outer layer tubular portion (FRP layer) 52 formed of a thermally cured prepreg is arranged on the outer layer side (outermost layer) to form a decorative layer so as to obtain carbon tone look and the appearance (designability and aesthetics) can be improved. For example, the appearance of the outer layer tubular portion (FRP layer) 52 can be arranged in a pattern that is the same as or corresponds to the appearance of the carbon golf club shaft 30.

Second Embodiment

In the above described first embodiment (FIG. 11 and FIG. 12), the inner layer tubular portion 51 is formed of a metal material, and the outer layer tubular portion 52 is formed of an FRP material. In the second embodiment, however, by reversing this positional relationship, the inner layer tubular portion 51 can be formed of an FRP material and the outer layer tubular portion 52 can be formed of a metal material (the illustration of the second embodiment is omitted).

Third Embodiment

Figure 13:
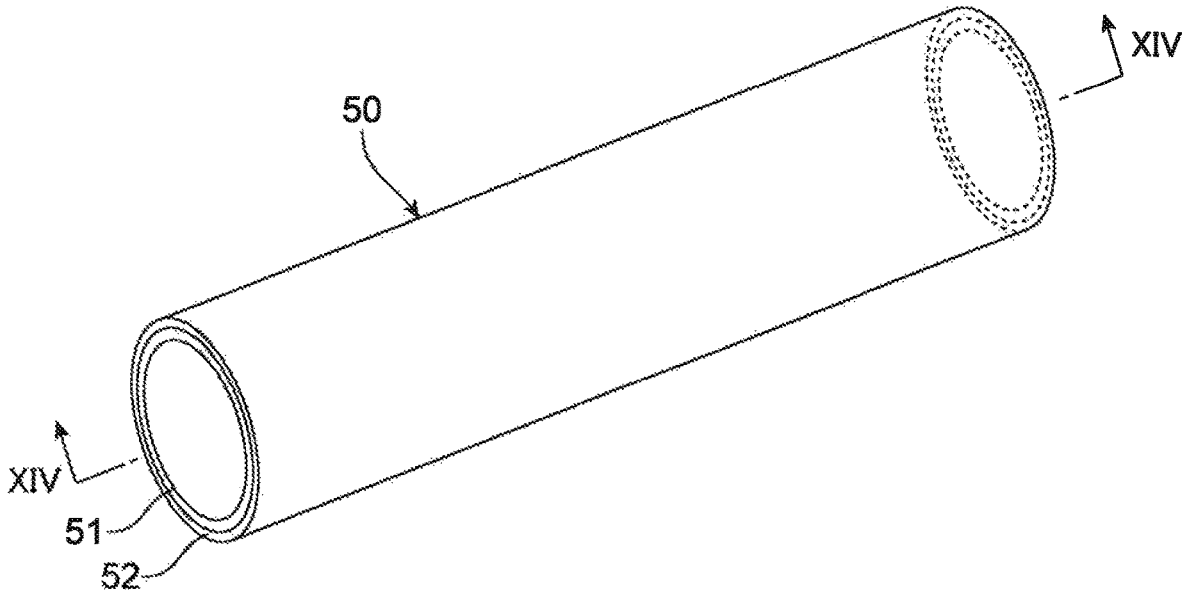
FIG. 13 is a perspective view illustrating a single structure of a tubular member according to a third embodiment.
Figure 14:
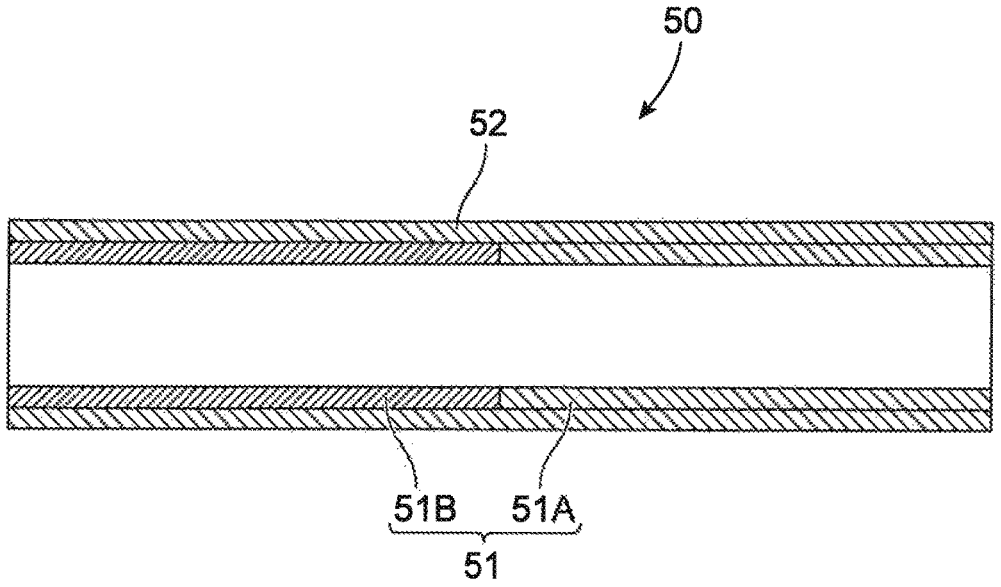
FIG. 14 is a cross-sectional view taken along the line XIV-XIV of FIG. 13.

FIG. 13 is a perspective view illustrating a single structure of a tubular member 50 according to a third embodiment. FIG. 14 is a cross-sectional view taken along the line XIV-XIV of FIG. 13.

As shown in FIG. 13 and FIG. 14, in the third embodiment, in the inner layer tubular portion 51, a part along the outer peripheral surface of the inserted cylindrical portion 32 of the carbon golf club shaft 30 is formed of an FRP material 51A and a part along the outer peripheral surface of the inserted shaft portion 42 of the over-hosel-type golf club head 40 is formed of a metal material 51B. Further, the outer layer tubular portion 52 is formed of an FRP material.

Fourth Embodiment

In the fourth embodiment, the outer layer tubular portion 52 can be formed of a metal material instead of the FRP material in the third embodiment (FIG. 13 and FIG. 14), (the illustration of the fourth embodiment is omitted).

Fifth Embodiment

In the first to fourth embodiments, the hybrid structure of the tubular member 50 can be achieved by providing a metal foil, plating, or the like on the outer peripheral surface of the outer layer tubular portion 52. Alternatively, the hybrid structure of the tubular member 50 can be achieved by forming the tubular member 50 as an integrally molded product of a metal material or an FRP material without dividing the tubular member 50 into the inner layer tubular portion 51 and the outer layer tubular portion 52, and by providing a metal foil or plating on the outer peripheral surface thereof.

In the above-described embodiment, an exemplary case has been described where the tubular member 50 has the hybrid structure combining the metal material and the FRP material. However, the hybrid structure of the tubular member 50 may be formed by any combination of different materials, and various design changes may be possible. For example, as the hybrid structure of the tubular member 50, a combination of a metal material and a rubber material, a combination of an FRP material and a rubber material, or a combination of a metal material, an FRP material and a rubber material may be adopted.

Further, as the hybrid structure of the tubular member 50, for example, a plurality of FRP materials (a UD prepreg, a biaxial woven prepreg, a triaxial woven prepreg, a quadriaxial woven prepreg, etc.) having different shapes, structures, characteristics, etc. may be combined. That is, the hybrid structure of the tubular member 50 may or may not include the FRP material, and when the FRP material is included, either one kind or plural kinds of the FRP material may be included. (It is sufficient that an FRP material is included as at least one of the different kinds of material).

In the above-described embodiment, an exemplary case has been described where the "inner-hosel-type golf club shaft" is the carbon golf club shaft. However, the "inner-hosel-type golf club shaft" is not limited to the carbon golf club shaft and may be one applicable to the inner-hosel-type golf club head but inapplicable to the over-hosel-type golf club head.

In the above-described embodiment, an exemplary case has been described where the "inner-hosel-type golf club shaft" is the carbon golf club shaft. However, the "inner-hosel-type golf club shaft" may be one formed of the thermally cured prepreg where the thermosetting resin is immersed in a reinforcing fiber, thus being not limited to the carbon one.

In the above-described embodiment, an exemplary case has been described where the golf club head is the putter club head. However, the golf club head may be an iron club head or a driver club head.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A golf club comprising:

an inner-hosel-type golf club shaft;

an over-hosel-type golf club head; and a connecting member that connects the inner-hosel-type golf club shaft and the over-hosel-type golf club head, wherein the connecting member includes a hybrid structure combining different kinds of material, and includes an FRP material as at least one of the different kinds of material, wherein the inner-hosel-type golf club shaft has an inserted cylindrical portion, the over-hosel-type golf club head has an inserted shaft portion, and the connecting member is formed of a tubular member into which the inserted cylindrical portion and the inserted shaft portion are inserted from opposite directions, and the tubular member is bonded on outer peripheral surfaces of the inserted cylindrical portion and the inserted shaft portion, wherein the tubular member includes an inner layer tubular portion along the outer peripheral surfaces of the inserted cylindrical portion and the inserted shaft portion, and an outer layer tubular portion along the outer peripheral surface of the inner layer tubular portion, and wherein the inner layer tubular portion is formed of a metal material, and the outer layer tubular portion is formed of an FRP material.

2. A golf club comprising:

an inner-hosel-type golf club shaft;

an over-hosel-type golf club head; and a connecting member that connects the inner-hosel-type golf club shaft and the over-hosel-type golf club head, wherein the connecting member includes a hybrid structure combining different kinds of material, and includes an FRP material as at least one of the different kinds of material, wherein the inner-hosel-type golf club shaft has an inserted cylindrical portion, the over-hosel-type golf club head has an inserted shaft portion, and the connecting member is formed of a tubular member into which the inserted cylindrical portion and the inserted shaft portion are inserted from opposite directions, and the tubular member is bonded on outer peripheral surfaces of the inserted cylindrical portion and the inserted shaft portion, wherein the tubular member includes an inner layer tubular portion along the outer peripheral surfaces of the inserted cylindrical portion and the inserted shaft portion, and an outer layer tubular portion along the outer peripheral surface of the inner layer tubular portion, and wherein the inner layer tubular portion is formed of an FRP material, and the outer layer tubular portion is formed of a metal material.

3. A connecting member that connects an inner-hosel type golf club shaft and an over-hosel-type golf club head, wherein the connecting member includes a hybrid structure combining different kinds of material, and includes an FRP material as at least one of the different kinds of material, wherein the inner-hosel-type golf club shaft has an inserted cylindrical portion, the over-hosel-type golf club head has an inserted shaft portion, and the connecting member is formed of a tubular member into which the inserted cylindrical portion and the inserted shaft portion are inserted from opposite directions, and the tubular member is bonded on outer peripheral surfaces of the inserted cylindrical portion and the inserted shaft portion, wherein the tubular member includes an inner layer tubular portion along the outer peripheral surfaces of the inserted cylindrical portion and the inserted shaft portion, and an outer layer tubular portion along the outer peripheral surface of the inner layer tubular portion, and wherein the inner layer tubular portion is formed of a metal material, and the outer layer tubular portion is formed of an FRP material.

4. A connecting member that connects an inner-hosel type golf club shaft and an over-hosel-type golf club head, wherein the connecting member includes a hybrid structure combining different kinds of material, and includes an FRP material as at least one of the different kinds of material, wherein the inner-hosel-type golf club shaft has an inserted cylindrical portion, the over-hosel-type golf club head has an inserted shaft portion, and the connecting member is formed of a tubular member into which the inserted cylindrical portion and the inserted shaft portion are inserted from opposite directions, and the tubular member is bonded on outer peripheral surfaces of the inserted cylindrical portion and the inserted shaft portion, wherein the tubular member includes an inner layer tubular portion along the outer peripheral surfaces of the inserted cylindrical portion and the inserted shaft portion, and an outer layer tubular portion along the outer peripheral surface of the inner layer tubular portion, and wherein the inner layer tubular portion is formed of an FRP material, and the outer layer tubular portion is formed of a metal material.

* * * * *